US011458496B2

(12) United States Patent
Audell et al.

(10) Patent No.: US 11,458,496 B2
(45) Date of Patent: Oct. 4, 2022

(54) FOLDABLE DISPOSABLE PROTECTIVE COVER FOR ROUND GANG BOXES AND LIGHTING HOUSINGS MOUNTED IN WALLS AND CEILINGS OF RESIDENTIAL AND COMMERCIAL BUILDINGS

(71) Applicants: Harry S. Audell, Park City, UT (US); Margaret S. Audell, Park City, UT (US)

(72) Inventors: Harry S. Audell, Park City, UT (US); Margaret S. Audell, Park City, UT (US)

( * ) Notice: Subject to any disclaimer, the term of this patent is extended or adjusted under 35 U.S.C. 154(b) by 0 days.

(21) Appl. No.: 17/092,256

(22) Filed: Nov. 7, 2020

(65) Prior Publication Data

US 2022/0143643 A1 May 12, 2022

(51) Int. Cl.
*B05B 12/24* (2018.01)
*E04G 21/30* (2006.01)

(52) U.S. Cl.
CPC ..... *B05B 12/24* (2018.02); *E04G 21/30* (2013.01)

(58) Field of Classification Search
None
See application file for complete search history.

(56) References Cited

U.S. PATENT DOCUMENTS 21,955 A * 11/1858 Grosholz ..... B05B 12/20 118/505
61,084 A * 1/1867 Millar ..... B05B 12/20 118/505
2,358,151 A * 9/1944 Duggan ..... B05B 12/20 118/505
2,880,902 A * 4/1959 Owsen ..... A45F 3/20 220/8
2,925,064 A * 2/1960 Kahn ..... B05B 12/20 118/505
3,335,703 A * 8/1967 Buehler ..... B05B 12/28 118/504
3,722,470 A * 3/1973 Farrell ..... B05B 12/20 118/505
4,327,663 A * 5/1982 Izzo ..... B05B 12/20 118/505
4,599,970 A * 7/1986 Peterson ..... B05C 13/00 118/504
4,656,058 A * 4/1987 Stark ..... B05B 12/20 427/282

(Continued)

*Primary Examiner* — Jethro M. Pence
(74) *Attorney, Agent, or Firm* — Steven Rinehart

(57) ABSTRACT

A foldable, disposable protective cover for round gang boxes and lighting housings mounted in walls and ceilings to prevent dust, joint compound, paint, and other building material from entering the receptacles during finish construction operations. This provides a safer electrical environment for electrical wire connections, light bulbs, switches and outlets. The cover is foldable from a stamped planar sheet. The cover is dimensioned to cover conventionally-sized openings of round gang boxes and lighting housings. The cover is easily extracted from a receptacle by lifting the lid from the body and applying hand pressure to crush the cover in-place. Once removed, the gang box or lighting housing interior edges can be easily shaved and sanded clean of excess dried joint compound or paint, to reveal a perfectly completed gang box or lighting housing ready for the installation of electrical components.

11 Claims, 8 Drawing Sheets

(56) References Cited

U.S. PATENT DOCUMENTS 4,695,468 A * 9/1987 Boston ..... C12G 3/026 426/8
4,747,366 A * 5/1988 Walker ..... B05B 12/20 118/504
4,764,421 A * 8/1988 Horiki ..... C23C 14/042 428/36.5
4,822,650 A * 4/1989 Horiki ..... B05B 12/20 428/34.2
4,825,805 A * 5/1989 Walker ..... B05B 12/20 118/504
4,921,028 A * 5/1990 Schwartz ..... B05B 12/24 150/155
5,003,128 A * 3/1991 Grondin ..... B05B 12/20 174/67
5,008,551 A * 4/1991 Randolph ..... E05B 17/106 16/414
5,285,014 A * 2/1994 Gilchrist ..... H01R 13/443 174/67
5,328,723 A * 7/1994 Horiki ..... B05B 12/26 427/272
5,432,298 A * 7/1995 Thompson ..... B05B 12/29 174/67
5,480,312 A * 1/1996 Watanabe ..... H01R 13/443 439/135
5,540,880 A * 7/1996 Horiki ..... B05D 1/32 264/553
5,690,795 A * 11/1997 Rosenstein ..... C23C 14/564 204/192.1
5,840,122 A * 11/1998 Williams ..... B05B 12/24 118/505
5,902,642 A * 5/1999 Horiki ..... B05B 12/20 427/282
6,103,974 A * 8/2000 Erdfarb ..... B05B 12/20 174/66
6,165,269 A * 12/2000 Kathe ..... B05B 12/20 118/505
6,227,623 B1 * 5/2001 Bellow ..... B05B 12/30 301/37.42
6,317,995 B1 * 11/2001 Hoffmann, Sr. ..... E04F 21/00 33/528
6,703,562 B1 * 3/2004 Pacheco ..... H02G 3/14 174/66
7,022,915 B1 * 4/2006 Galguera ..... B05B 12/20 174/66
7,067,738 B1 * 6/2006 Shotey ..... H02G 3/14 174/66
7,071,413 B1 * 7/2006 Paape ..... H02G 1/00 174/66
7,077,909 B1 * 7/2006 Crane ..... B05B 12/24 118/500
7,105,057 B1 * 9/2006 Colussi ..... B05B 12/29 118/504
7,798,837 B1 * 9/2010 Gardner ..... H01R 13/6397 439/296
8,580,345 B2 * 11/2013 Van't Hof ..... B05B 12/24 427/282
9,061,305 B1 * 6/2015 Martinez ..... B05B 15/16
2008/0197133 A1 * 8/2008 McKay ..... B05B 12/20 220/359.1
2009/0271967 A1 * 11/2009 Orr ..... A62C 99/00 29/428
2016/0030964 A1 * 2/2016 Mikesell, Sr. ..... B05B 12/24 118/505
2017/0066007 A1 * 3/2017 Brown ..... B05B 12/24
2019/0232314 A1 * 8/2019 Lujan ..... B05B 12/26

* cited by examiner

FOLDABLE DISPOSABLE PROTECTIVE COVER FOR ROUND GANG BOXES AND LIGHTING HOUSINGS MOUNTED IN WALLS AND CEILINGS OF RESIDENTIAL AND COMMERCIAL BUILDINGS

FIELD OF THE INVENTION

This invention pertains to protecting the interior of round electrical gang boxes and lighting housings constructed in ceilings and walls within residential and commercial buildings. By use of a foldable and disposable round cover, electrical gang boxes and lighting housings are protected from contamination by joint compound and paint that typically occurs during the drywall and painting phases of construction. This cover keeps the interior of the gang box and lighting housing clean of these deleterious materials. Moreover, the electrical components installed into the clean gang boxes and lighting housings will assuredly perform properly. Later replacement of an electrical component, usually by a homeowner, is performed with ease and confidence.

BACKGROUND

Description of the Related Art

The unintended effects of drywalling and painting around round recessed gang boxes and lighting housings (or receptacles) that are present in residential and commercial buildings, whether new or remodel construction, presents contractors with many difficulties. These difficulties pertain primarily to the contamination of the interior of these receptacles with joint compound, paint and sawdust. Typically, drywall is crudely cut around these receptacles and spacious gaps are created that require patching with tape and joint compound. During the patching process, the interior of these receptacles become filled with joint compound and other deleterious materials. The same applies to the painting process. Sometimes the contractor will insert wads of paper to protect the interior of these receptacles, but most often this unsophisticated technique is ineffective. Later cleaning of these receptacles is usually not performed by the contractor because it is difficult, cumbersome and time-consuming to correct. Internal wiring, light bulbs, switches, sockets, or fixtures placed in or on contaminated receptacles can interfere with their proper operation. Electrical components installed in contaminated, poorly fitted and finished gang boxes and lighting housings have led to hazardous conditions (i.e. fire) that may jeopardize the health, welfare and safety of building occupants and the general public. There is no municipal regulation that governs the fit and finish of gang boxes or lighting housings, but building owners frequently complain about their installation and are forced to pay for unnecessary labor to finish them properly. This invention, the foldable, disposable, protective cover for round ceiling and wall mounted gang boxes and lighting housings corrects that situation.

Square covers for recessed square gang boxes, (either 1-, 2-, 3- or 4-gang), exist in the art for protecting the wire holes, box screw holes and wires from contamination derived from various construction products or procedures (U.S. Pat. No. 10,707,661). Round covers for recessed round gang boxes and lighting housings, constructed either in ceilings or walls are unknown in the art. This round cover can protect any size or diameter of gang box or lighting housing.

During drywall placement, drywall contractors typically cut a round hole in the portion of the drywall, or other material, that overlies the receptacle. The hole is to correspond to the circumference of the gang box or lighting housing. This process is usually performed by hand using a razor blade or by electric cutting tool and without the assistance of jigs or templates. It is difficult by visual means to accurately measure and cut holes in the drywall that perfectly contour the receptacle. Accordingly, the cutting process is inaccurate and additional cutting is often necessary. Sections of the drywall are often overcut leaving an unacceptably wide gap around the gang box and/or the lighting housing. As a result, additional work and expense is required to correct this situation.

There are currently no standardized protocols in the industry or national building codes for protecting the interior of round gang boxes and lighting housings during finishing of interior ceilings and walls. This increases the likelihood that materials such as sawdust, joint compound, and paint will remain and contaminate the receptacles, creating a hazardous potential for electrical short-circuit and fires as well as appearing aesthetically unpleasing. In commercial and residential construction applications, there is a need to provide a product that enhances the quality of construction in this area.

The inconvenience or the difficulty encountered by craftsmen and finishers could be substantially alleviated if a device which addresses these shortcomings was available. There is a substantial need for a means of curing these deficiencies in the art.

Use of the disclosed foldable, disposable, protective cover for round gang boxes and lighting housings mounted in walls and ceilings facilitates several primary functions. These are: (1) the protection of the wiring inside the gang box and lighting housing from joint compound, paint and sawdust; (2) the provision of a clean interior environment for affixing or connecting additional wiring, or light bulbs or other fixtures; (3) the improvement of construction quality as well as the advancement of state-of-the-art construction practices, (4) the reduction of fire hazards related to defective drywall and paint construction, and (5) this is disposable as a non-hazardous substance.

SUMMARY

From the foregoing discussion, a need exists for a foldable, disposable cover that protects round gang boxes and ceiling and wall mounted lighting housings. Beneficially, such a device would overcome inefficiencies with the current state-of-the-art practice of applying joint compound and paint by providing an inexpensive, efficient means of protecting open receptacles during construction. This would ultimately facilitate improvement in the state-of-the art construction methods and provide to the customer receptacle interiors that are clean of deleterious materials such as joint compound, paint and sawdust.

The present invention has been developed in response to the present state-of-the-art, and in particular, in response to the problems and needs in the art that have not yet been fully solved by currently available devices. Accordingly, the present invention has two uses. It has been developed to provide a foldable, disposable, protective cover for round gang boxes and lighting housings. For the gang box cover, it comprises the following: a rectangular body dimensioned to be rolled into substantially cylindrical configuration and align within the interior periphery of a standardized round gang box and lighting housing; the body having a planar forward surface and a planar rearward surface; wherein the body comprises a plurality of rectangular sections adjoined across the breadth of the body, the sections separated by one of nonperforated and/or perforated creases; a circular top plate connected to the body with a planar strip, the circular top plate defining a tab; wherein the circular top plate is adapted to be pressed into position within the body when the body is rolled into a substantially cylindrical configuration.

Two or more tabs may be formed from cutting the body in an unfolded configuration to extend laterally from one side of the body forming a lateral recess between.

A third tab may extend laterally from the body, the lateral recess adapted to contour an exterior periphery of the third tab.

The cover may comprise one of cardboard, polymeric materials, metallic materials and/or organic materials.

A water proof material consisting of a polyurethane spray, a polylaminate film, wax and/or an acrylic spray may be applied to the cover.

The cover may be formed as a single integrated piece or formed as multiple separate pieces.

In various embodiments, the cover is adapted to be easily removed by crushing the cover within the receptacle to break the bond of the joint compound against the cover.

The cover may be adapted to facilitate ready shaving and sanding of excess dried joint compound and paint inside round gang boxes or lighting housings.

A tab is formed on the top plate (i.e. lid) and when pushed through creates an aperture.

The body may further define one or more notches cut from a bottom edge of the body, each of the notches spanning one to ten sections.

Another use of the foldable, disposable, protective cover is for round lighting housings and comprises the following: a rectangular body dimensioned to be rolled into substantially cylindrical configuration and align within the interior periphery of a standardized round gang box and lighting housing; the body having a planar forward surface and a planar rearward surface; wherein the body comprises a plurality of rectangular sections adjoined across the breadth of the body, the sections separated by one of nonperforated and/or perforated creases; a circular top plate connected to the body with a planar strip, the circular top plate defining a tab; wherein the circular top plate is adapted to be pressed into position within the body when the body is rolled into a substantially cylindrical configuration.

Two or more tabs may be formed from cutting the body in an unfolded configuration to extend laterally from one side of the body forming a lateral recess between.

A third tab may extend laterally from the body, the lateral recess adapted to contour an exterior periphery of the third tab.

The cover may comprise one of cardboard, polymeric materials, metallic materials and/or organic materials.

A water proof material consisting of a polyurethane spray, a polylaminate film, wax and/or an acrylic spray may be applied to the cover.

The cover may be formed as a single integrated piece or formed as multiple separate pieces.

In various embodiments, the cover is adapted to be easily removed by crushing the cover within the receptacle to break the bond of the joint compound against the cover.

The cover may be adapted to facilitate ready shaving and sanding of excess dried joint compound and paint inside round gang boxes or lighting housings.

A tab is formed on the top plate (i.e. lid) and when pushed through creates an aperture.

The body may further define one or more notches cut from a bottom edge of the body, each of the notches spanning one to ten sections.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages and uses of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided for a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The particular embodiment discussed below, is one of "one embodiment". The cover is a single component that comprises a body, neck and lid. There is a substrate layer and a surficial laminate layer that is affixed to the substrate. The term "cover" (i.e. foldable, disposable protective cover for round gang boxes and lighting housings mounted in walls and ceilings of residential and commercial buildings).

The term cover, which includes the body, neck and lid, as shown in view 100, will be referred to as "cover 100".

Figure 1:
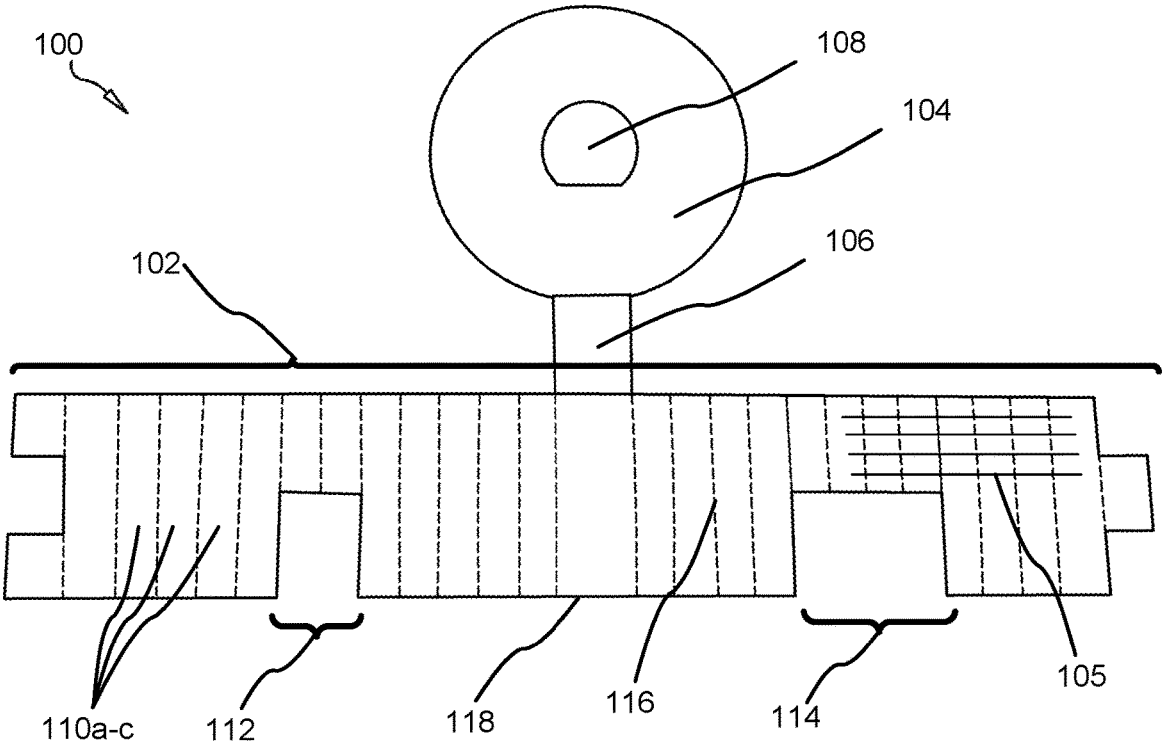
FIG. 1 is a top view perspective showing the physical configuration of a cover (i.e. a foldable disposable protective cover for round gang boxes and lighting housings mounted in walls and ceilings of residential and commercial buildings) in a flat and unfolded state in accordance with the present invention.
Figure 2:
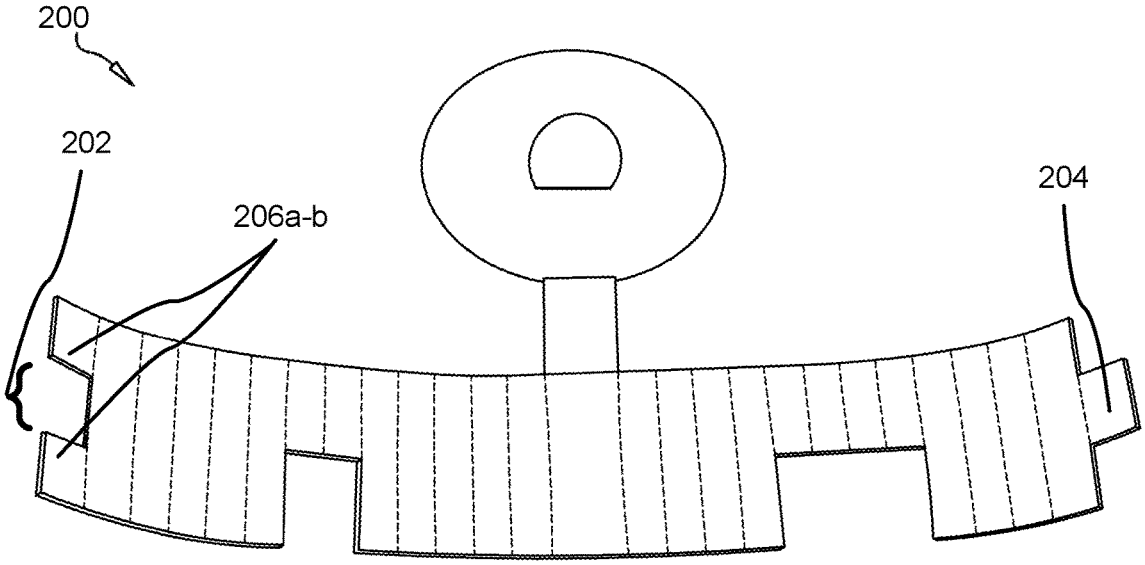
FIG. 2 is an isometric view perspective showing the physical configuration of a cover with the body in a slightly rolled state in accordance with the present invention.

FIGS. 1 and 2 illustrate top view perspectives (100 and 200) of a cover 100 in a flat and unfolded configuration, and an isometric view perspective of a cover 100 in a gently rolled and unfolded configuration, in accordance with the present invention.

The substrate material of the cover, shown in views 100 through 900, may be formed from cardboard, metallic, polymeric materials, or organic materials (e.g., wood, paper or leather). The cover 100 may be formed from a single integrated piece of cardboard cut, stamped or molded. The body of the cover 100 may comprise a substrate material component and a surficial material component.

The surface material of the cover 100 may comprise a laminate affixed to the substrate as a top layer. The laminate may be applied to both sides of the substrate. The laminate may consist of a polymeric film: polyurethane, polyethylene, polyvinyl chloride, or other type of plastic compound.

The cover 100 may be formed as a singular piece of material comprising a body 102, neck 106, and lid 104. The body 102 may be rectangular with an attached rectangular neck 106 with attached round lid 104. When rolled and folded, the rectangular body 102 substantially forms a cylinder with an insertable lid 104, which cylinder aligns with the interior periphery of a standardized round gang box or lighting housing. The gang box and lighting housing will hereby be referred to as a "receptacle". In an unfolded configuration, the cover 100 has a planar forward surface and a planar rearward surface. The body 102 may comprise a plurality of rectangular sections 110 adjoined across the breadth of the body 102, the sections 110 separated by one of creases and/or perforated creases. The lid 104 is connected to the body 102 by a rectangular planar strip of material or neck 106. The lid 104 has a central defining round tab, that when pushed through becomes aperture 108. The lid 104 is adapted to be folded at the neck and pressed and inserted into position mid-way within the cylindrical body 102 after the body 102 is rolled and inserted into the receptacle. Joint compound may be used to fill the gap around the cover 100 and the surrounding drywall surface. After the joint compound has dried, the lid 104 is initially lifted from the body 102, the walls of the body 102 crushed inward, and the cover 100 removed from the receptacle. What remains is a clean perfectly constructed receptacle ready for placement of internal electrical components.

The body 102 is the primary feature of the cover. It is rectangular in shape in a flat and unfolded configuration. The body 102 length exceeds its width and is dimensionally proportioned to facilitate the circumference and depth of the receptacle. When rolled (i.e. with ends attached) the body 102 forms a round wall configuration. The body 102 may vary in the dimensional length and width, and may vary in proportion and configuration depending upon the dimensions of the make, model, and size of the receptacle for which the cover 100 is intended.

Spanning the body 102 are many parallel creases 116 positioned perpendicular to the longitudinal axis (defined as the length of the unfolded body 102). These creases 116 may be equilaterally and dimensionally spaced and positioned to facilitate the rolling of the body 102 for insertion into the receptacle. The creases 116 may be perforated or non-perforated. The creases 116 are regularly spaced along the length of the body 102 forming vertical sections 110. The creases 116 may be of varying number, dimension and configuration, depending upon the dimensions of the body and the make, model, and size of the intended receptacle.

A laterally extending male and female tab/notch system interlocks the body 102 at both ends when attached, maintaining the cylindrical wall configuration of the body 102. At one side of the flat and unfolded body 102 is the female end 202 where the upper and lower tabs 206 which mate with a central notch are situated, and at the opposite side of the body 102 is the male end where one central tab 204 is positioned. When attached, the frictional resistance keeps the ends tightly connected. These tabs and notches may be of varying number, dimension, configuration, and position depending upon the dimensions of the body and the make, model, and size of the receptacle.

Two notches 112 and 114 at the bottom of the flat and unfolded body 102 are created for properly aligning and positioning the rolled cover 100 into the receptacle. These notches may be of varying number, dimension, configuration, and position depending upon the dimension of the body and the make, model, and size of the receptacle for which it is intended.

A rectangular strip of like-material or neck 106, whether the body is flat or rolled, connects the body 102 to the lid 104. The neck 106 length is dimensionally proportional to the preferred depth of placement for the lid 104 into the rolled body 102, and its width is proportional to the length. Two creases are located at the top and bottom of the neck 106. Both creases operate as hinges for the folding of the lid 104 into the body 102 after the body 102 has been rolled. These creases may be perforated or non-perforated. The dimension and proportion of the neck's 106 length may vary in dimension, configuration, and position on the body depending upon the dimensions of the body and the make, model, and size of the receptacle for which it is intended.

At the top of the neck 106, whether the body 102 is flat or rolled, is a round top plate or lid 104. The diameter of the lid 104 is equal to or slightly larger than the diameter of the body 102 when rolled and when tab 204 is inserted into notch 202. When inserted into the receptacle, the rolled body's 102 fit is to be tight. The lid's 104 preferred depth of placement is located approximately mid-way within the rolled body 102, and when the rolled body 102 and positioned lid 104 are inserted into the receptacle, the lid 104 is to be slightly recessed below the lip of the receptacle. Its purpose is to exert pressure at the interior of the inserted body 102, while applying pressure on the interior of the receptacle creating a friction fit. The lid 104 may be of varying diameter, dimension, configuration, and position depending upon the dimensions of the body 102 and the make, model, and size of the receptacle for which it is intended.

Centrally located within the lid 104 is a round push-through tab 108. When pushed with the forefinger, an aperture 308 is created although the tab 108 remains attached to the lid 104. This aperture 308 is for lifting the lid 104 with the forefinger in order to separate the lid 104 from the walls of the body 102. At the side of the tab 108 is a crease to facilitate folding. The tab 108 folds inward into the body 102 when pressed. The tab 108 may be of varying diameter, dimension, configuration, and position depending upon the dimensional size of the lid.

The cover 100 may include a rectangular body 102 which is dimensioned to be substantially rolled into cylindrical form. In a rolled configuration, the cover 100 is adapted optimally to align with a round gang box and/or ceiling lighting housing of standardized shape and size. The body 102 may be of any size or dimension, such that it can be manufactured to fit a typical round gang box or lighting housing.

In this particular embodiment, the body 102 comprises creases, or perforated creases, at regular dimensionally spaced intervals. The creases (or perforated creases) are indicated as 116. The creases 116 form a plurality of rectangular sections 110 *a-c*, aligned across the breadth of the body 102 and perpendicular to the corrugation or grain of the substrate 105.

In this particular embodiment, the body 102 may define a plurality of recesses or notches 112, 114 and 202. The notches 112 and 114 may span the width of one, two, three or four or more sections 110 laterally and may rise from one-quarter inches to three-quarter inches, from a bottom edge 118 of the body 102. The planar faces of the sections 110 are useful for forming a friction fit with the interior round surfacing of a receptacle.

The height of the notches 112 and 114 dictates the depth of which the rolled body 102 resides into the gang box or lighting housing. In this particular embodiment, the vertical height of the notches, 112 and 114, is nearly equivalent to the lip or opening of the receptacle.

Two tabs 206*a-b* extend laterally from the body 102 and create a male-female end-to-end connection system. These two tabs 206*a-b* form a notch 202 between them. A third tab 204 extends laterally from the opposite side of the body 102. The third tab 204 may be adapted to be received by the notch 202. The notch 202 may contour the third tab 204. When tab 204 recesses into notch 202 a tight friction fit is formed to keep the ends of the body 102 firmly attached, thus forming a cylindrical configuration to the body 102.

The top tab 206*a-b* is aligned with a top edge of the body 102. The bottom tab 206*a-b* is aligned with the bottom edge 118 of the body 102.

A strip of material, or neck 106 extends perpendicularly off the top-side of the body 102. It is located at the middle of the body 102. The neck is two sections, 110 *a-c*, wide and one-half the body 102 height. There is a crease, or perforated crease at its connection with the body 102 and another at the connection with the lid 104.

A circular top plate or lid 104 is connected at the top of the neck 106. The lid 104 is round and equal, or slightly larger in diameter to the inside diameter of the body 102 when rolled and attached at its ends. The lid 104 folds into the rolled body via bending at the top and bottom creases in the neck 106. The lid is to fit tightly within the interior of the rolled body to create a pressure fit. This provides a friction fit of the cover to stay in place inside the receptacle.

Within the lid 104 is a push-through tab 108. The tab 108 is centrally located in the lid 104. The tab 108 is partially cut from the lid 104. When the tab 108 is pushed inward towards the rolled body 102 an aperture 308 is created. Its purpose is to allow a forefinger to push the tab 108 inside the rolled body 102 to facilitate the lifting of the lid 104.

The body 102 is folded around itself to form a substantially cylindrical tube for insertion into an open round gang box or lighting housing, and protecting the same from contamination with joint compound, paint, plaster and other building materials during finishing. The rolled body 102 engages the receptacle and forms an interior friction fit therewith.

The body 102 may define creases or creases with perforations 116 for facilitation of rolling and folding. Additionally, the tabs 204 and 206*a-b* may be cut, defined or formed from the body 102.

The surficial material component of cover 100 may comprise a laminate composed of a polymeric film, including a polyurethane, polyethylene, polyvinyl chloride, or other type of plastic compound.

The laminate is to be resistant to moisture, water, joint compound and paint, by use of a polymeric film, or any other resistant medium affixed onto the exterior surface of the substrate of cover 100.

The corrugation (105), grain, alignments, nap, lineation (either linear or sublinear), or physical or molecular alignments of the cover 100 may be parallel to the longitudinal axis of the body 102.

The cover 100 may be formed as a single integrated piece comprising the body, neck and lid. Other embodiments may include a separate body with a separate lid.

Figure 3:
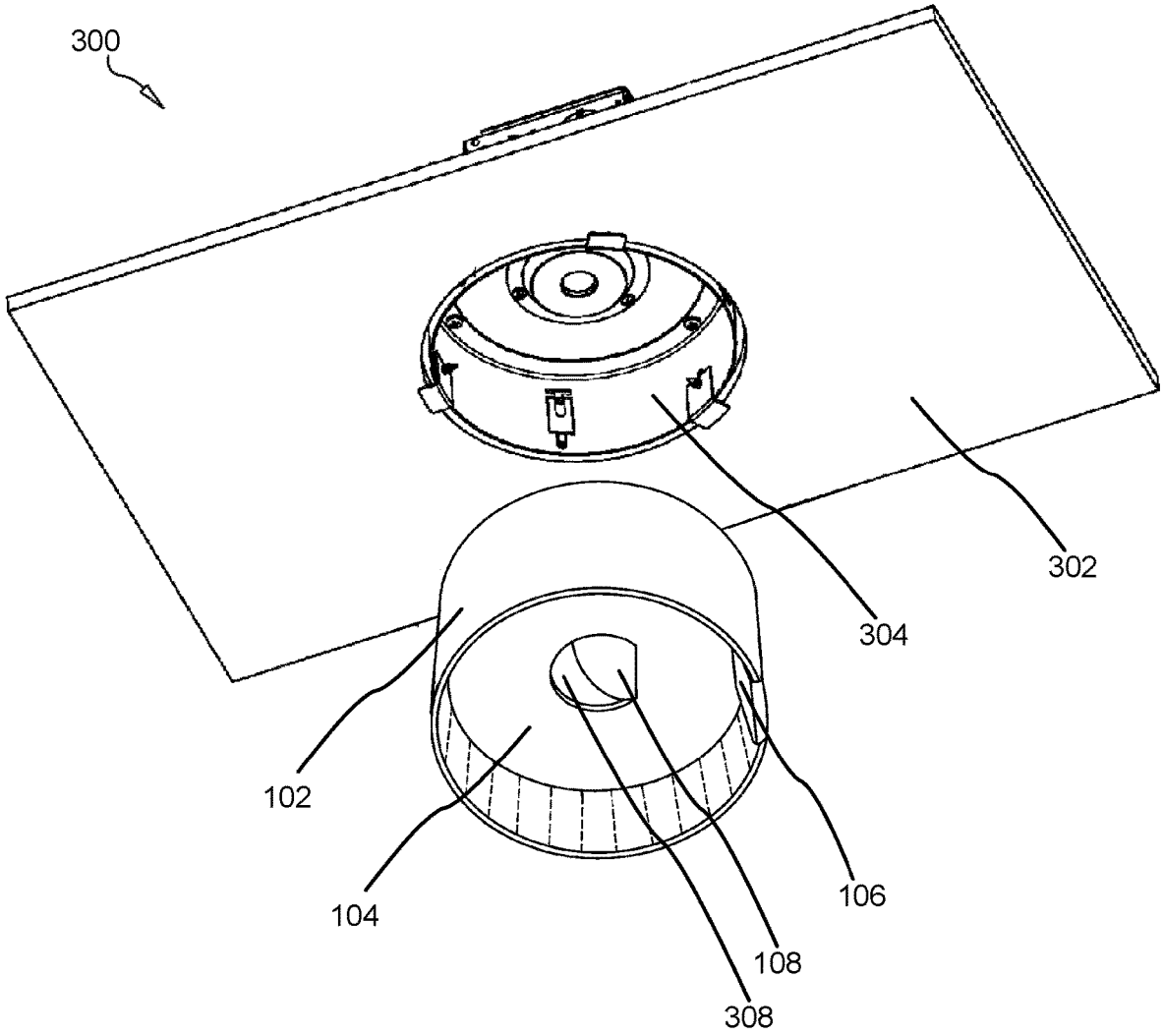
FIG. 3 is an isometric lower view perspective of a cover with body completely rolled with inserted lid and in position for insertion into a lighting housing, in accordance with the present invention.

FIG. 3 is an isometric view perspective 300 of cover 100 fully assembled in a rolled and folded configuration, positioned for insertion into a ceiling lighting housing 304 in accordance with the present invention.

The cover 100 aligns with the perimeter of a recessed ceiling lighting housing mounted superiorly to a ceiling structure 302, and inserts within the ceiling lighting housing

304 forming a friction fit therewith. The body 102 contours, or substantially contours the interior periphery of the exposed ceiling lighting housing 304. Typical embodiments of the cover 100 are dimensioned to insert into standard ceiling lighting housings 304.

The ceiling lighting housing 304 comprises a fixture kit recessed into the ceiling surface 302. These fixtures 304 are often installed during new construction or remodeling of residential and commercial buildings. The fixtures are typically sold as a commercial kit for use by consumers and contractors, and may be designed to house LED lights, halogen lights, or incandescent bulbs in new or preexisting ceiling space. The fixtures 304 (or lighting housings 304) often comprise a heat sink adapted to dissipate heat upwards into an attic space.

The rolled body 102 protrudes inferiorly from the ceiling lighting housing allowing joint compound to be inserted into the annulus formed between the drywall and ceiling lighting housing 304 as a filler.

The rolled body 102, neck 106 and lid 104 are treated to be moisture resistant. In various embodiments, the body 102, neck 106 and lid 104 may be coated with an impermeable membrane to resist absorption of water, oil, paint, joint compound and other wet materials. A film, laminate and in some cases polymeric tape or wax may be adhered to one or more exterior or interior surfaces of the body 102, neck 106 and lid 104. The body 102, neck 106 and lid 104 may be sprayed with an acrylic or polyurethane spray.

After the joint compound has dried, or while the paint is still wet, the inserted rolled body 102 is easily removed from the receptacle by first lifting the lid 104 from the rolled body 102, using the aperture 308, and then crushing the body 102 inward.

Once the rolled body 102 is removed from the lighting housing 304 the interior edges of the lighting housing can be easily shaved and sanded clean of excess dried joint compound to reveal a perfectly completed round gang box or lighting housing.

Figure 4:
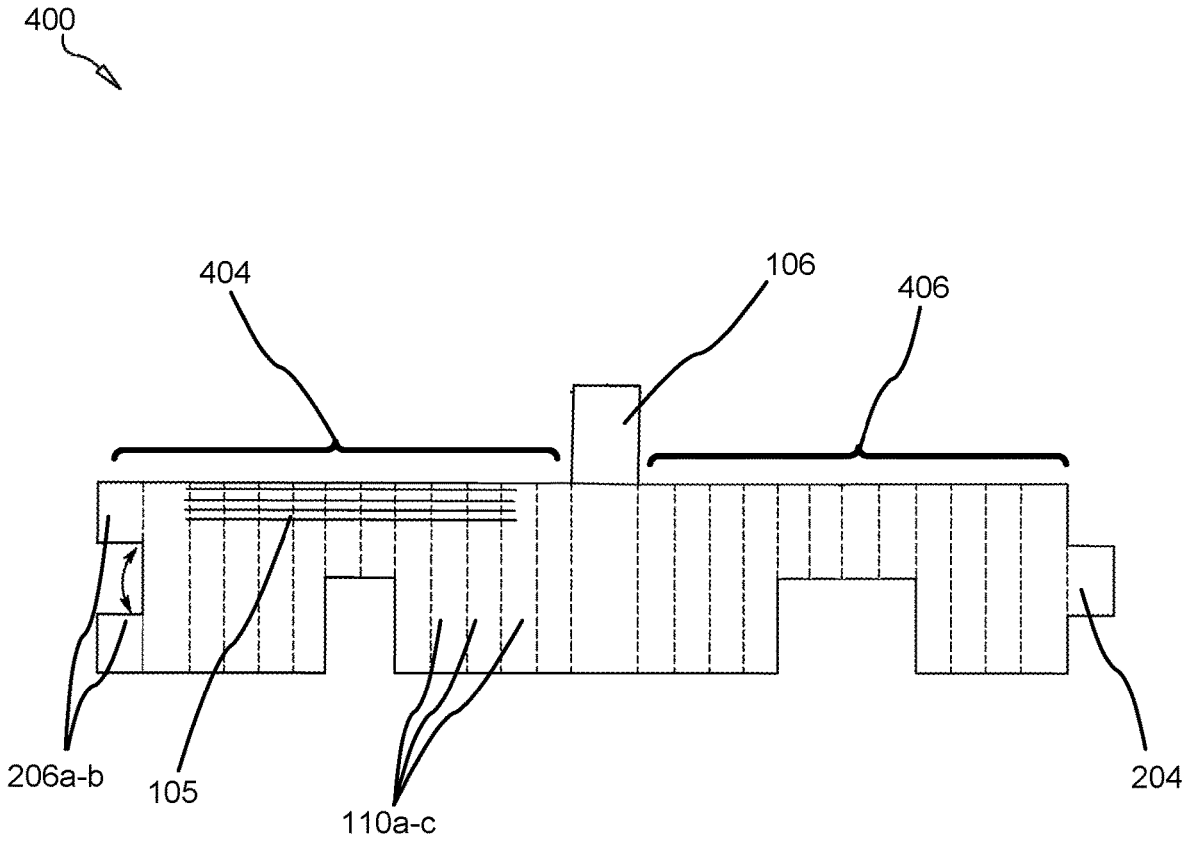
FIG. 4 is a top view perspective of a cover with neck, but without the lid in a flat and unfolded state in accordance with the present invention.

FIG. 4 is a top view 400 of a cover in a flat and unfolded configuration in accordance with the present invention. The cover in view 400 is shown without the lid 104.

Figure 5A:
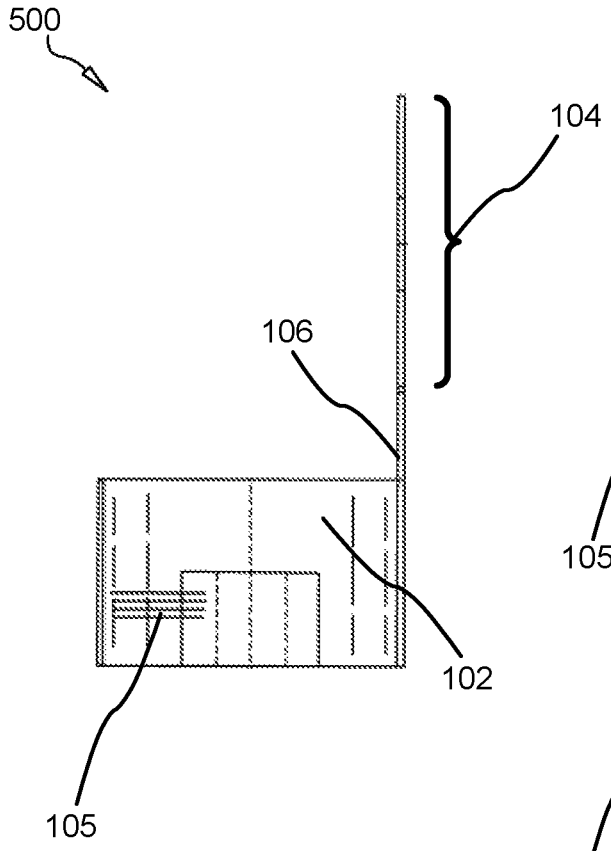
FIG. 5A is a side view perspective of a cover with the body in a completely rolled configuration with neck and lid extending outward in a planar position parallel to the walls of the body, in accordance with the present invention.

FIG. 5A is a side view perspective 500 of the cover 100 with the body 102 rolled and partially assembled, and with the neck 106 and lid 104 extending perpendicularly from the body 102.

Figure 5B:
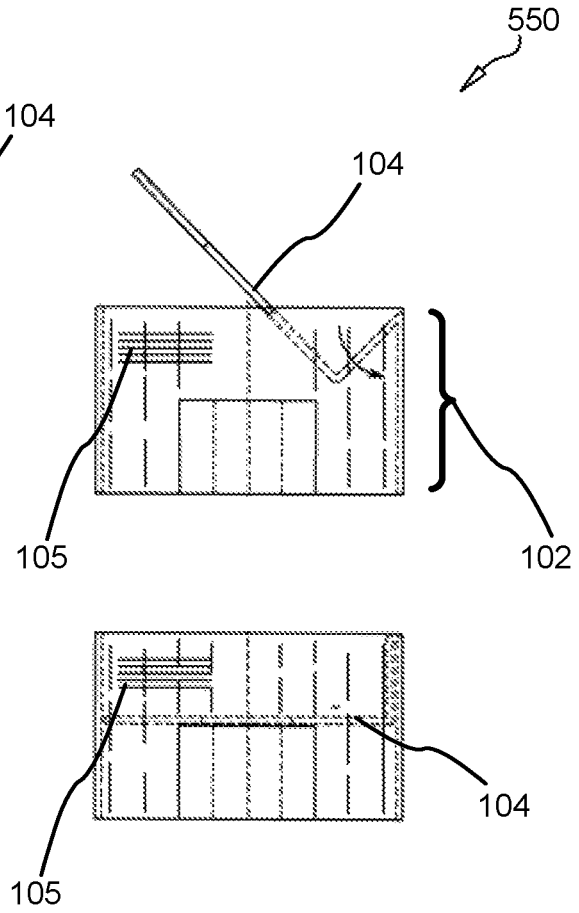
FIG. 5B is of two illustrations. The upper illustration is a side view perspective of a cover with a completely rolled body and lid partially inserted into the body. The lower illustration is a side view of a cover with a completely rolled body with the lid fully inserted into the body, in accordance with the present invention.

FIG. 5B is a side view perspective 550 of the cover 100 showing the body 102 rolled and fully assembled, and with the neck 106 and lid 104 partially inserted into the body 102. The lower illustration of same FIG. 5B shows the body 102 rolled and fully assembled with neck 106 and lid 104 fully inserted into the body 102 indicating a fully assembled cover 100.

Figure 6:
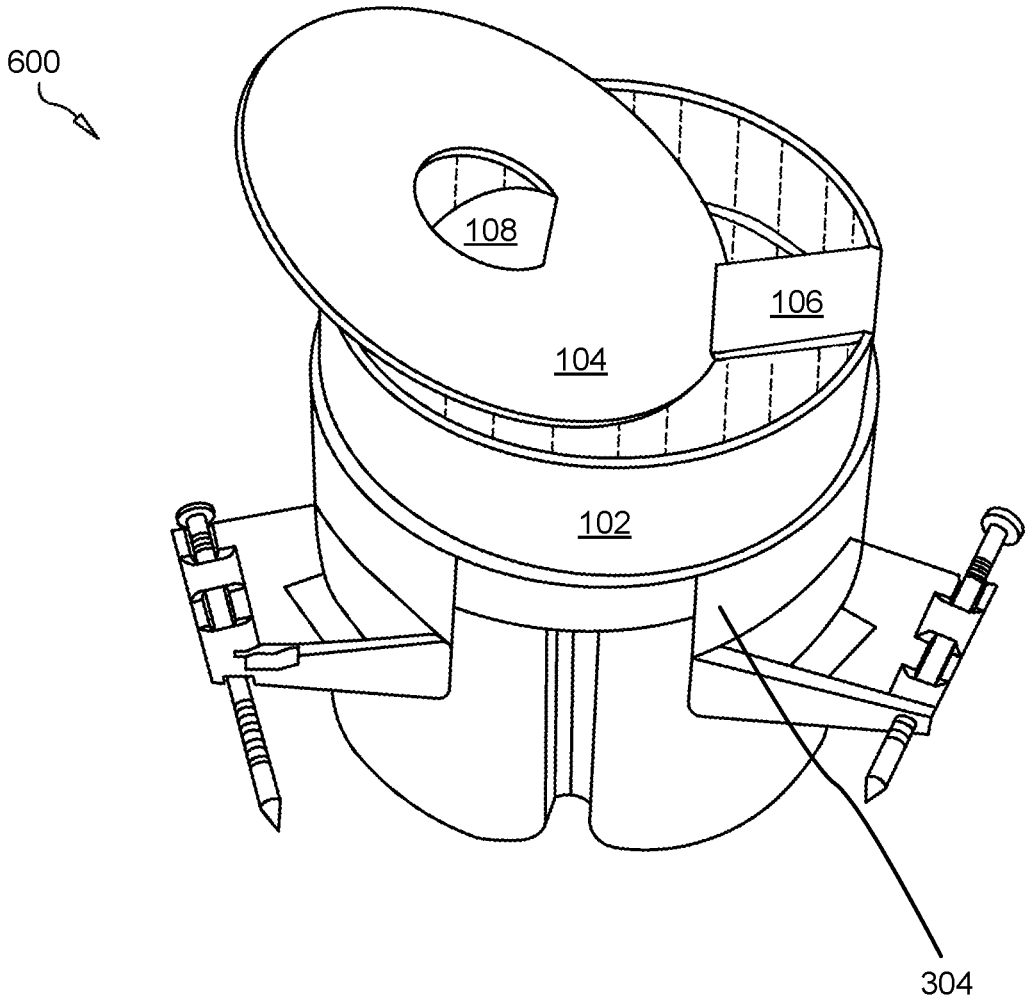
FIG. 6 is an isometric upper view perspective of a cover with the body fully inserted into a gang box and lid partially folded over the body, in accordance with the present invention.

FIG. 6 is an upper isometric view perspective 600 of a cover 100 with the body 102 fully assembled and inserted into the gang box 304 with the neck 106 and lid 104 partially folded over the body 102. The tab 108 is partially pushed through creating an aperture 308 at the center of the lid 104.

Figure 7:
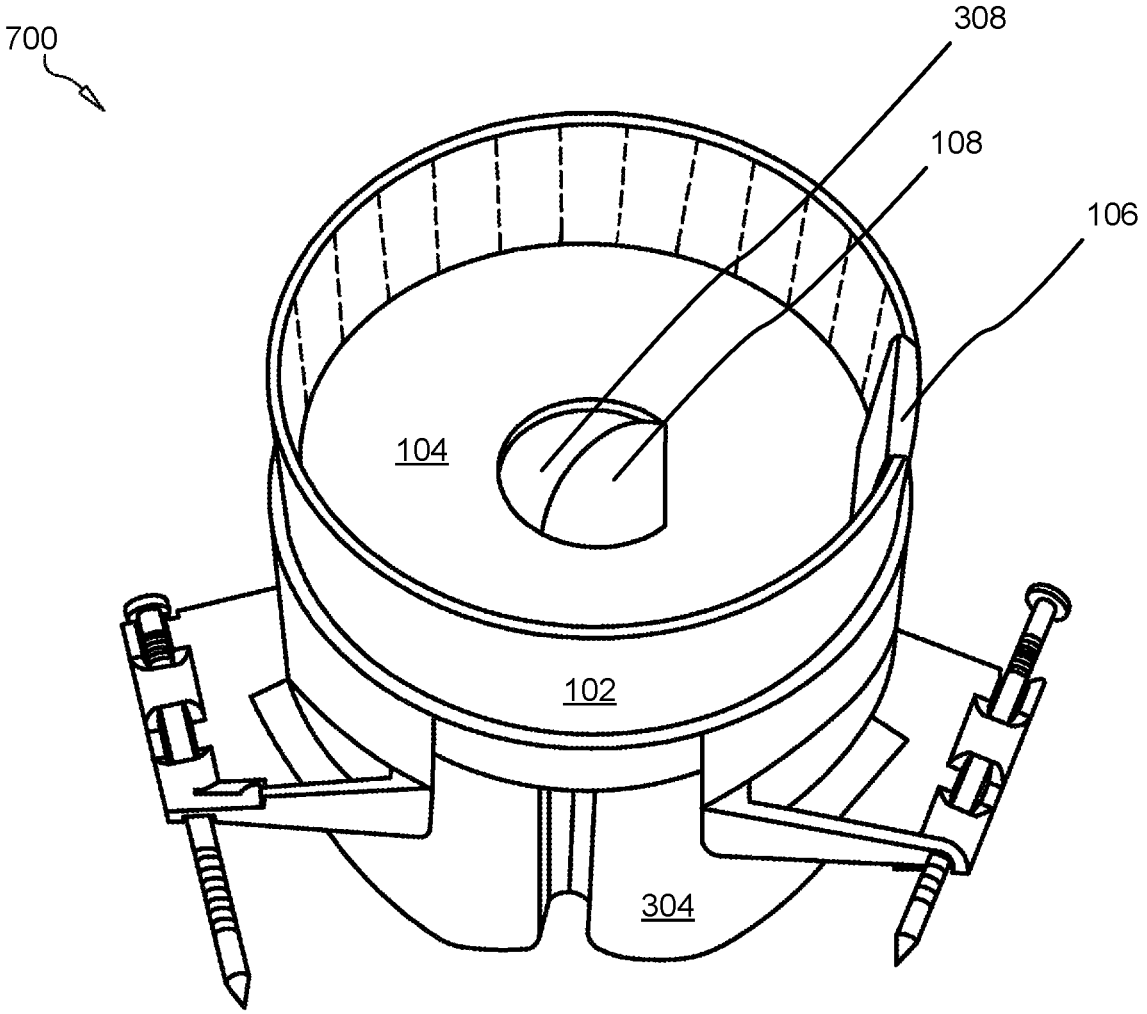
FIG. 7 is an isometric upper view perspective of a cover with the body fully inserted into a gang box and lid fully inserted into the body. The view also shows the side position of the neck relative to the body and lid, in accordance with the present invention.
Figure 8:
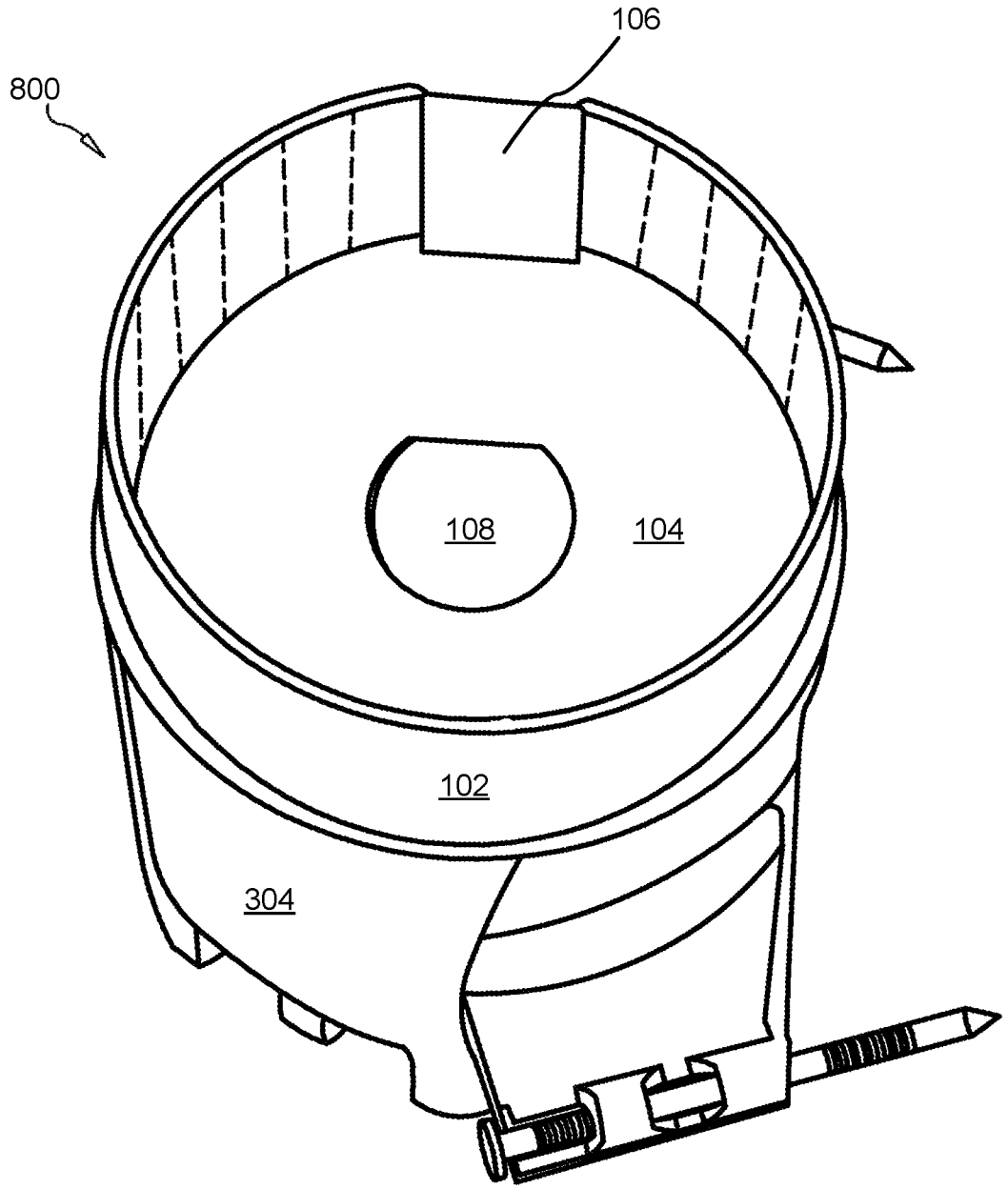
FIG. 8 is an isometric upper view perspective of a cover with the body fully inserted into a gang box and lid fully inserted into the body. The view also shows the front position of the neck relative to the body and lid, in accordance with the present invention.

FIGS. 7 and 8 are upper isometric view perspectives (700 and 800) of covers 100 with the body 102, the neck 106 and lid 104 fully assembled and inserted into the gang box 304. The tab 108 is partially pushed through creating an aperture 308 at the center of the lid 104.

Figure 9:
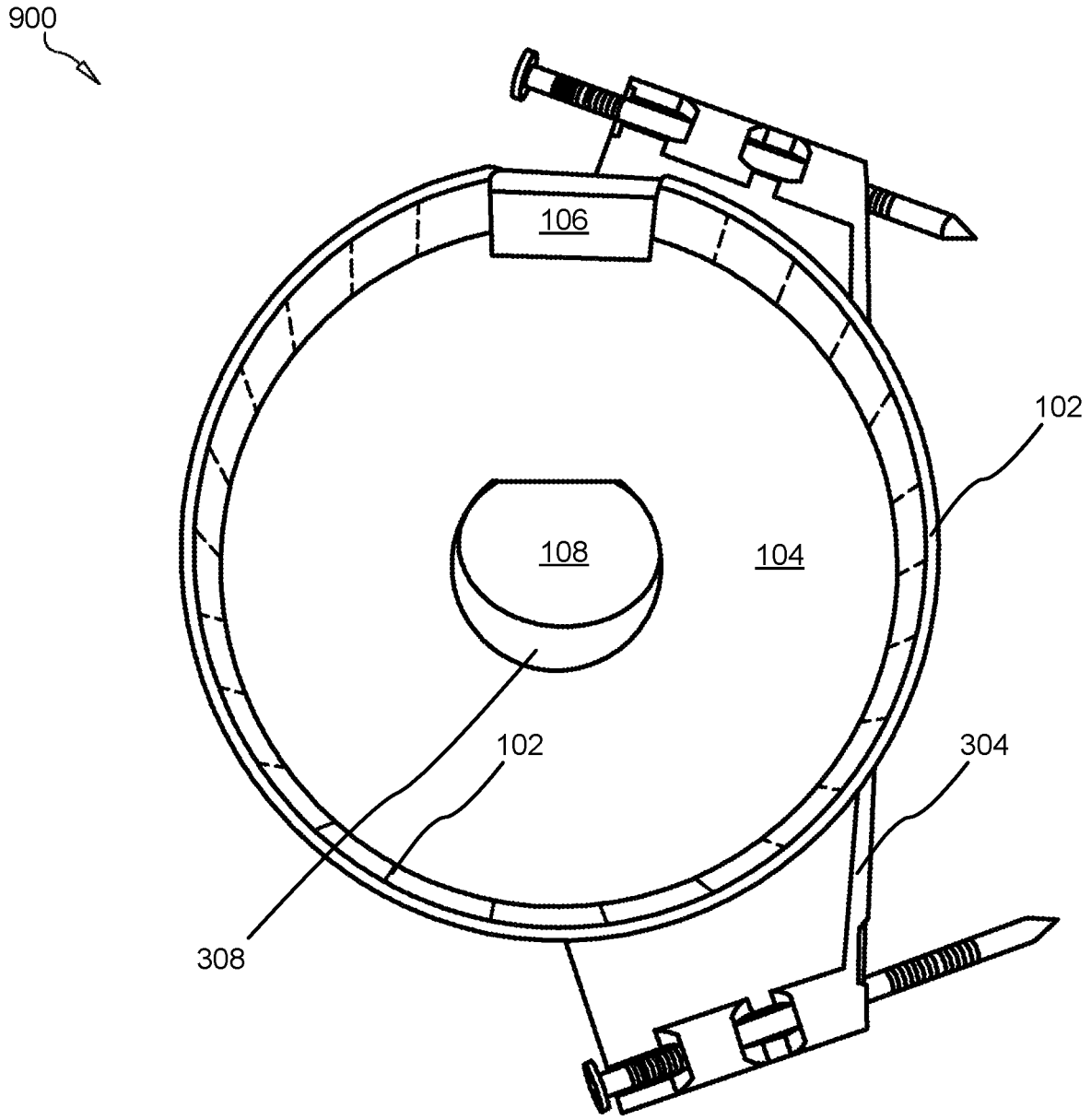
FIG. 9 is a top view perspective of a cover with the body fully inserted into a gang box and lid fully inserted into the body. The view also shows the front position of the neck relative to the body and lid, in accordance with the present invention.

FIG. 9 is a top view perspective 900 of a cover 100 with the body 102, the neck 106 and lid 104 fully assembled and inserted into the gang box 304. The tab 108 is partially pushed through creating an aperture 308 at the center of the lid 104.

In each of the views 600 through 900, the cover 100 is shown fully inserted into a round gang box 304. The cover 100 contours to the interior of the round gang box 304.

The invention claimed is:

1. A foldable, disposable, protective cover for round gang boxes mounted in walls and ceilings comprising:

a rectangular body dimensioned to be rolled into cylindrical configuration and align within an interior periphery of a round gang box, the body having a planar forward surface and a planar rearward surface;

wherein the body comprises a plurality of rectangular sections adjoined across a breadth of the body, the plurality of rectangular sections separated by one of nonperforated and/or perforated creases;

a circular top plate or lid connected to the body by a planar strip or neck, the circular top plate containing a tab;

wherein the circular top plate is adapted to be pressed into position within the body when the body is rolled into a cylindrical configuration.

2. The cover of claim 1, wherein two or more additional tabs formed from cutting the body in an unfolded configuration extend laterally from one side of the body forming a lateral recess between.

3. The cover of claim 2, wherein a third tab extends laterally from the body, the lateral recess adapted to contour an exterior periphery of the third tab.

4. The cover of claim 1, wherein the cover comprises one of cardboard, metallic materials, polymeric materials, and organic materials.

5. The cover of claim 1, wherein one of a polymeric material, tape or spray creates a laminate film that is applied to the cover.

6. The cover of claim 1, wherein the cover is formed as either a single integrated piece, or multiple separate pieces.

7. The cover of claim 1, wherein the cover is adapted to be removed by crushing the cover within the receptacle breaking the barrier of the dried joint compound against the body.

8. The cover of claim 1, wherein the cover is adapted to be removed by crushing the cover within the receptacle while paint is still wet.

9. The cover of claim 1, wherein the cover is adapted to facilitate ready shaving and sanding of excess dried joint compound or dried paint from an interior of a round gang box.

10. The cover of claim 1, wherein an additional tab is created on the top plate or lid such that when pushed through creates an aperture.

11. The cover of claim 1, wherein the body further defines one or more notches cut from a bottom edge of the body, each of the notches spanning one to ten of the plurality of rectangular sections.

* * * * *